US009152131B2

(12) United States Patent
Mokhnatkina et al.

(10) Patent No.: US 9,152,131 B2
(45) Date of Patent: Oct. 6, 2015

(54) SNOOZE ALARM SYSTEM FOR A WEARABLE DEVICE

(71) Applicant: Motorola Mobility LLC, Libertyville, IL (US)

(72) Inventors: Maria N Mokhnatkina, San Jose, CA (US); Dmitri R Latypov, San Mateo, CA (US); Ravi Jain, Palo Alto, CA (US); Mikhail Petrov, Cupertino, CA (US)

(73) Assignee: Google Technology Holdings LLC, Mountain View, CA (US)

( * ) Notice: Subject to any disclaimer, the term of this patent is extended or adjusted under 35 U.S.C. 154(b) by 168 days.

(21) Appl. No.: 13/942,159

(22) Filed: Jul. 15, 2013

(65) Prior Publication Data

US 2014/0269223 A1 Sep. 18, 2014

Related U.S. Application Data

(60) Provisional application No. 61/781,293, filed on Mar. 14, 2013.

(51) Int. Cl.

| | |
|---|---|
| ***G08B 23/00*** | (2006.01) |
| ***G04G 13/02*** | (2006.01) |
| ***G04G 21/02*** | (2010.01) |

(52) U.S. Cl.

CPC ..... *G04G 13/02* (2013.01); *G04G 21/025* (2013.01)

(58) Field of Classification Search

CPC ... G04G 13/021; G04G 13/02; G04G 21/025; G04G 21/16; E06B 2009/2625; E06B 2009/6818; E06B 2009/6872; E06B 9/32; E06B 9/322; E06B 9/38; E06B 9/62; E06B 9/70; E06B 9/72; H04W 52/0238

USPC ..... 340/575, 573.2, 573.3, 586, 588, 5.52, 340/5.61, 5.81, 5.82, 10.33; 600/595, 300

See application file for complete search history.

(56) References Cited

U.S. PATENT DOCUMENTS

| | | | |
|---|---|---|---|
| 4,228,806 | A | 10/1980 | Lidow |
| 5,101,831 | A | 4/1992 | Koyama et al. |
| 5,928,133 | A | 7/1999 | Halyak |
| 7,306,567 | B2 | 12/2007 | Loree, IV |
| 2002/0080035 | A1 | 6/2002 | Youdenko |

(Continued)

FOREIGN PATENT DOCUMENTS

| | | | |
|---|---|---|---|
| DE | 19642316 | A1 | 4/1998 |
| JP | 8160172 | A | 6/1996 |

OTHER PUBLICATIONS

Maciek Drejak Labs, Sleep Cycle Alarm Clock, Jan. 28, 2012, Apple iTunes, India.

*Primary Examiner* — Daniel Previl

(74) *Attorney, Agent, or Firm* — Shumaker & Sieffert, P.A.

(57) ABSTRACT

A wearable device in one embodiment includes a motion detection sensor, an alarm clock and a sleep monitor operatively coupled to the motion detection sensor and the alarm clock. The sleep monitor monitors a person during sleep by collecting motion detection sensor data at a first data collection rate and determines a sleep state of the person based on the collected motion detection sensor data at the first data collection rate. If the sleep monitor detects that the alarm clock has entered a snooze mode, then the first data collection rate is increased to a second data collection rate and motion detection sensor data is collected at the second data collection rate while the alarm clock system in the snooze mode.

16 Claims, 3 Drawing Sheets

(56) References Cited

U.S. PATENT DOCUMENTS

| | | | | |
|---|---|---|---|---|
| 2005/0012622 | A1 | 1/2005 | Sutton | |
| 2007/0142945 | A1* | 6/2007 | Beckmann et al. | 700/94 |
| 2009/0102669 | A1* | 4/2009 | Lin | 340/575 |
| 2010/0128571 | A1* | 5/2010 | Roh et al. | 368/11 |
| 2011/0163859 | A1* | 7/2011 | Chraime et al. | 340/309.16 |
| 2011/0230790 | A1* | 9/2011 | Kozlov | 600/595 |
| 2011/0245688 | A1 | 10/2011 | Arora | |
| 2014/0180595 | A1* | 6/2014 | Brumback et al. | 702/19 |

* cited by examiner

SNOOZE ALARM SYSTEM FOR A WEARABLE DEVICE

CROSS-REFERENCE TO RELATED APPLICATIONS

The present disclosure claims priority to U.S. Provisional Patent Application No. 61/781,293, filed Mar. 14, 2013, entitled "SNOOZE ALARM SYSTEM FOR A WEARABLE DEVICE," which is hereby incorporated herein in its entirety.

FIELD OF THE DISCLOSURE

The present disclosure relates generally to wearable devices and other mobile devices and more particularly to devices that monitor the sleep cycles or sleep state of the user.

BACKGROUND

Various alarm clock systems and other monitoring systems exist that operate by collecting some physiological parameters of the user during sleep, and processing the data in order to determine one or more sleep states of the user. Sleep states may be considered as falling into four broad categories: a) the deep sleep state, b) the shallow sleep state, c) the Rapid Eye Movement (REM) state, and d) an intermediate state where the user is partially awake yet partially sleep. Additionally, the data obtained from scientific research implies that the most optimum "waking up" experience is realized when a person transitions from the REM state to the awake state.

Determination of a person's sleep states may be accomplished using known techniques, and a variety of mechanisms exist for controlling and regulating the wake-up and snooze alarms based on such techniques. In one example alarm clock system, a wake-up alarm is triggered based on a user-defined wake-up time, following which either the user acknowledges this alarm or where the alarm is automatically disabled after a predefined period of time. Subsequent to this event, the first of a series of snooze alarm modes is automatically enabled. At this point in time the user must perform some action to disable the first or all of the snooze alarm modes. Also, depending on the sleep state of the user during the subsequent snooze alarms, the user may or may not respond to the subsequent snooze alarms.

DETAILED DESCRIPTION

Figure 1:
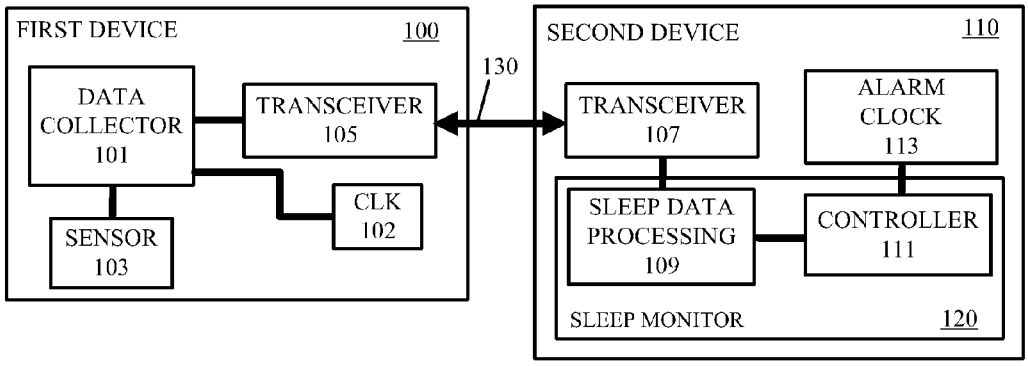
FIG. 1 is a partial schematic diagram of a wearable device and another mobile device in accordance with an embodiment.

The present disclosure provides various systems, devices and methods of operation. One method of operation includes monitoring a person during sleep by collecting sensor data at a first data collection rate, and determining a sleep state of the person based on the collected sensor data at the first data collection rate. Upon detecting that an alarm clock system has entered a snooze mode the method includes increasing the first data collection rate to a second data collection rate and collecting sensor data at the second data collection rate while the alarm clock system in the snooze mode.

The method of operation may also increase the rate of determining the sleep state of the person while the alarm clock system in the snooze mode. The method of may also include making a determination that the person is awake and automatically disabling the snooze mode.

The method of operation also may include determining that the person has entered into a given sleep state while the alarm clock system in the snooze mode and immediately triggering a snooze alarm in response to the determination of the given sleep state. For example, the method of operation may involve determining that the person has entered into a rapid eye movement (REM) sleep state and triggering the alarm at that point.

The collection of sensor data may be accomplished by collecting motion data as the sensor data, however other types of data may be collected in some embodiments such as the person's temperature or some other physiological parameter.

In some embodiments, the method of operation may increase the first data collection rate to a second data collection rate by increasing a clock frequency driving a motion data collector. The method of may also include sending collected sensor data from a first device to a second device over a wireless link, and receiving a control signal at the first device from the second device and increasing the first data collection rate to the second data collection rate in response to the control signal.

In another embodiment, the method may include processing collected sensor data at a first device to determine the given sleep state of the person and sending a control signal from the first device to a second device and immediately triggering the snooze alarm in response to the control signal.

The present disclosure also provides a wearable device that has a motion detection sensor, an alarm clock system and a sleep monitor. The sleep monitor is operatively coupled to the motion detection sensor and the alarm clock, and is operative to monitor a person during sleep by collecting motion detection sensor data at a first data collection rate. The sleep monitor determines a sleep state of the person based on the collected motion detection sensor data at the first data collection rate, detects that the alarm clock system has entered a snooze mode, and increases the first data collection rate to a second data collection rate and collects motion detection sensor data at the second data collection rate while the alarm clock system in the snooze mode.

The sleep monitor is also operative to increase the rate of determining the sleep state of the person while the alarm clock system in the snooze mode. The sleep monitor may determine that the person is awake and automatically disable the snooze mode, or may determine that the person has entered into a given sleep state while the alarm clock system in the snooze mode and immediately trigger a snooze alarm in response to the determination of the given sleep state. For example, the sleep monitor is operative to determine that the person has entered into a REM sleep state and immediately trigger the snooze alarm in response to the person entering the REM sleep state.

The sleep monitor also increases a frequency or rate of sleep state determination events while the alarm clock system in the snooze mode.

Another disclosed wearable device includes a motion detection sensor and a motion data collector operatively coupled to the motion detection sensor. The motion data collector collects motion detection sensor data at a first data collection rate and sends the motion detection sensor data to a second device using a wireless link based on the first data collection rate. The motion data collector may receive a control signal from the second device using the wireless link, and increase the first data collection rate to a second data collection rate and collect motion detection sensor data at the second data collection rate, and send the motion detection sensor data to the second device using the wireless link based on the second data collection rate. A clock circuit may be operatively coupled to the motion data collector such that the motion data collector may increase the first data collection rate to the second data collection rate by increasing a clock frequency of the clock circuit in response to the control signal from the second device.

A system is disclosed that includes a wearable device as described above and a mobile device. The mobile device includes an alarm clock, and a sleep monitor operatively coupled to the alarm clock. The sleep monitor obtains motion detection sensor data from the wearable device using the wireless link, and determines a sleep state of a person based on the collected motion detection sensor data at the first data collection rate. The sleep monitor in the mobile device also detects that the alarm clock has entered a snooze mode, and sends a control signal to the wearable device using the wireless link to increase the first data collection rate to the second data collection rate. In the disclosed system, the sleep monitor in the processes collects motion sensor data to determine a given sleep state of the person and immediately triggers a snooze alarm in response to a control signal. The given sleep state may be a REM sleep state or some other sleep state or sleep state transition.

Figure 2:
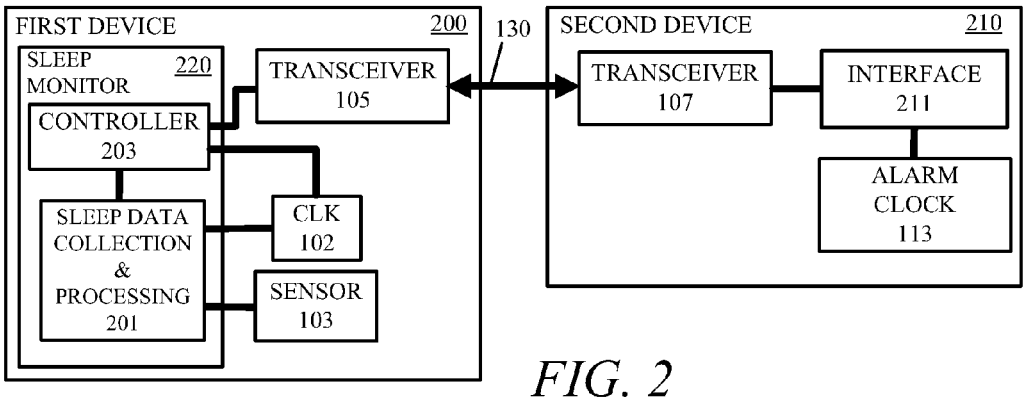
FIG. 2 is a partial schematic diagram of a wearable device and another mobile device in accordance with an embodiment.
Figure 3:
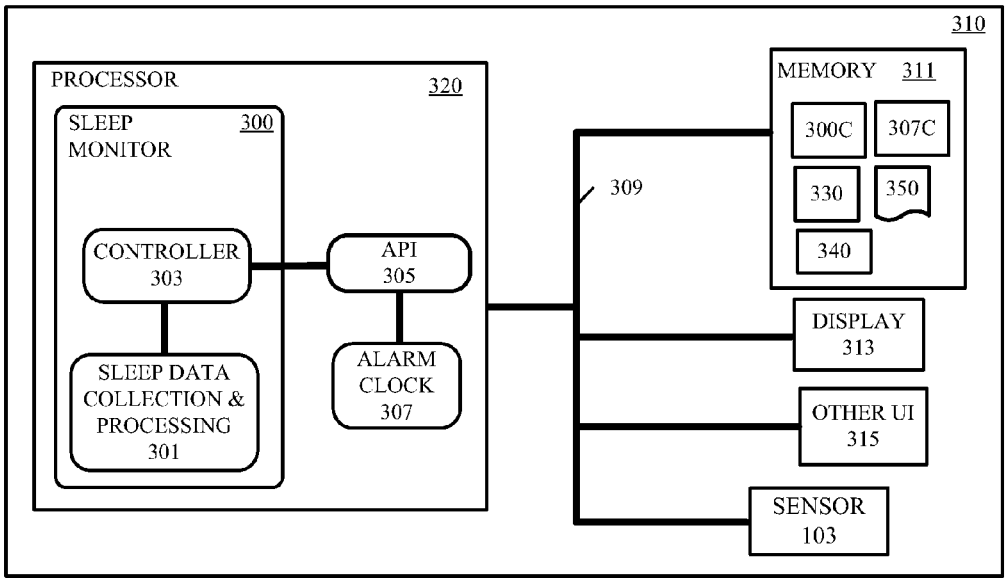
FIG. 3 is 1 is a partial schematic diagram of a mobile device, which may also be a wearable device, in accordance with an embodiment.

Turning now to the drawings, FIG. 1 illustrates a partial schematic block diagram of a first device and a second device that form a system in accordance with some embodiments. It is to be understood that the schematic block diagrams provided herein in FIG. 1, FIG. 2 and FIG. 3 are partial schematic block diagrams in that, although the diagrams show at least those components necessary to describe the features and advantages of the various embodiments to those of ordinary skill, various other components, circuitry, and devices may be necessary in order to implement a complete functional apparatus such as the example wearable and other mobile devices and that those various other components, circuitry, devices, etc., are understood to be present in the various embodiments by those of ordinary skill.

In FIG. 1, the first device 100 is a wearable device which includes a wireless transceiver 105. As mobile devices decrease in size due to continuing advances in miniaturization technologies, some have become "wearable devices" in the sense that these devices may be worn by a user as a fashion accessory such as jewelry, an article of clothing, a portion of an article of clothing, etc. A wearable device may have any suitable structure and therefore the possible wearable devices may include a ring, a wristwatch, a button or brooch which may include a pin for attaching to clothing, or a patch that may be sewn to, or into, clothing such as a shirt or blouse, etc. Other example wearable devices may include an anklet, a belt buckle, etc.

The wireless transceiver 105 of the wearable device may utilize any suitable wireless technology such as Bluetooth™, Wireless USB, ZigBee, or any other suitable wireless technology that may form a wireless link 130 between the first device and the second device to transfer information or command and control signaling there-between. The second device 110, which may be a mobile device, includes a like wireless transceiver 107 which can also receive wireless signals from, and send wireless signals to, the wireless transceiver 105 of the first device 100 over the wireless link 130. The first device 100 includes a sensor 103 operatively coupled to a data collector 101. The various devices that are described herein as being operatively coupled means that one or more intermediate or intervening components may exist between, or along the connection path between two such components such that the components are understood to be operatively coupled in that data or commands or control signals can be sent from one to the other and vice versa.

The wireless sensor 103 may be any suitable sensor that can sense and collect motion data such as, but not limited to, an accelerometer, a gyroscopic position sensor, a capacitive touch sensor configured to detect motion, etc. In other embodiments, the sensor 103 may be a physiological sensor that detects temperature or heart rate, etc.

The data collector 101 may, in some embodiments, be driven by an adjustable clock circuit 102. The adjustable clock circuit 102 provides a pulse train at predetermined intervals of time in order to drive the data collector 101 to obtain data from the sensor 103. The adjustable clock circuit 102 may be adjusted so that the frequency or rate of data collection from the sensor 103 by the data collector 101 may be increased or decreased by adjusting the frequency or rate of the adjustable clock circuit 102. The data collector 101 is also operatively coupled to the transceiver 105 such that it may send data over the wireless link 130 to the second device 110. The data collector 101 is also operative to receive command and control signals from the second device 110 by way of the transceiver 105 and the wireless link 130. For example, a controller 111 within the second device 110 may send a command signal to the data collector 101 and the adjustable clock circuit 102 to increase the clock frequency or rate so that the rate of data collection from the sensor 103 by the data collector 101 is likewise increased.

The second device 110, which may be a mobile device such as a mobile telephone or a standalone electronic alarm clock, or some other electronic device, includes a sleep monitor 120. The sleep monitor 120 may have components that include a sleep data processing unit 109 that is operatively coupled to the wireless transceiver 107 and to the controller 111. The controller 111 is in turn operatively coupled to the alarm clock 113, and provides intermediary control to the alarm clock 113 based on information obtained from the sleep data processing unit 109. For example, the sleep data processing unit 109 may determine a sleep cycle or sleep state of the person wearing the wearable device, i.e. first device 100. The sleep data processing unit 109 may develop a hypnagogic record, such as for example a hypnagogic chart or graph, of a particular user's sleep pattern such that the alarm clock 113 may be adjusted according to the particular individuals sleep pattern. The alarm clock 113 includes a snooze mode that may be invoked automatically when the primary wake-up alarm is not immediately acknowledged by the user, or when the user manually invokes the snooze mode. For example, the user may wake up partially in response to the wake-up alarm, and press a button on the second device 110 that invokes the snooze mode. In accordance with various embodiments, in response to snooze mode of the alarm clock 113 going into operation, the controller 111 will detect snooze mode and will send a control signal over the wireless link 130 to the first device 100. The control signal will increase the clock greater frequency of adjustable clock circuit 102 such that the data collector 101 begins to collect sensor data from sensor 103 at a second data collection rate which is higher than the first data collection rate.

Collection of the sensor data from sensor 103 at the second data collection rate continues as long as the alarm clock 113 is in the sleep mode. Among other advantages, increasing the data collection rate of the data collector 101 enhances the granularity of the hypnagogic information which is processed by the sleep data processing unit 109 such that transitions from one sleep state to another sleep state may be more readily detected such that features of the alarm clock 113 such as, but not limited to, the snooze mode may be more appropriately controlled for a particular user's physiology.

In one example of advantages realized by the various embodiments, the controller 111 of the sleep monitor 120 may detect that alarm clock 113 has entered into a snooze mode and accordingly increase the rate of data collection by the data collector 101 to a second data collection rate which is higher than a first data collection rate. The sleep data processing unit 109 will receive the collected sensor data and process the data accordingly to determine the user's sleep state and any transitions from one sleep state to another.

Based on a particular given sleep state, or on a detected transition from one sleep state to another sleep state, the controller 111 may send a control signal to the alarm clock 113 to immediately trigger the snooze alarm and attempt to wake up the user. For example, the sleep data processing unit 109 may determine, from the sensor data collected at the second data collection rate, that the user has entered into REM sleep. The controller 11 may then send a control signal to the alarm clock 113 to trigger the snooze alarm. In other words, the controller 111 will trigger the snooze alarm prior to expiration of the snooze alarm timer based on a given sleep state, or a transition from one sleep state to another sleep state, detected by the sleep monitor 120. Unlike prior systems, the increase in rates of data collection during the snooze mode provides the advantage of being more likely to detect transitions from one sleep state to another sleep state while the alarm clock 113 is in the snooze mode.

In addition to increasing the data collection rate the sleep data processing unit 109 may also increase the number of intervals, in other words the frequency or rate, at which the sleep state determinations are made. Another system in accordance with another embodiment is illustrated in FIG. 2.

A first device 200 which may be a wearable device, includes a sleep monitor 220 operatively coupled to a transceiver 105 which is the same type transceiver that uses the same type of wireless link 130 as the system described in the embodiment of FIG. 1. The sleep monitor 220 is likewise operatively coupled to a sensor 103 and to an adjustable clock circuit 102. The sleep monitor 220 may be composed of a controller 203 and a sleep data collection and processing unit 201. That is, in the embodiment illustrated in FIG. 2, the data collection and sleep data processing functions are integrated into a single unit. The second device 210 is operative to communication with the first device 200 using the wireless link 130, and may be a mobile device, alarm clock or some other electronic device similar to the second device 110 described with respect to FIG. 1. The second device 210 includes a wireless transceiver 107 and an alarm clock 113. The alarm clock 113 is operatively coupled to the transceiver 105 via an interface 211. The interface 211 is operative to receive command and control signals from the sleep monitor 220 of the first device 200. Operation of the system illustrated in FIG. 2 is similar to operation of the system shown in FIG. 1 however in FIG. 2 the operational decisions are made by the sleep monitor 220 located in the first device 200. As the sensor 103 senses data, the sleep data collection and processing unit 201 collects the data from the sensor 103 according to the rate or frequency of the clock pulse generated by adjustable clock circuit 102. The controller 203 may receive information from the alarm clock 113 via the interface 211, and over the wireless link 130, that informs the controller 203 when the alarm clock 113 has entered a sleep mode of operation. In that case, the controller 203 may control the adjustable clock circuit 102 to increase the clock rate or frequency which accordingly increases the rate of data collection of the sleep data collection and processing unit 201. That is, the data collection rate is increased from a first data collection rate to a higher second data collection rate.

Accordingly, the sleep data collection and processing unit 201 will also increase the intervals for making a determination of the user sleep state based on the increased amount of data received from the sensor 103. Upon determination of a given sleep state, or determination of a transition from one sleep state to another sleep state, by the sleep data collection and processing unit 201, the controller 203 may appropriately sent command-and-control signals over the wireless link 130 to the second device 210. For example, if the sleep data collection processing unit 201 detects that the user has transitioned from one sleep state to a given sleep state, the controller 203 may send a command signal over the wireless link 130 to the alarm clock 113 by way of the interface 211. The control signal may cause the alarm clock 113 to immediately trigger and sound the snooze alarm in response to the user having entered or transitioned to a given sleep state. As discussed in the example above with respect to FIG. 1, this may be done when the user enters a REM sleep state. However, this action may be taken for various other sleep states that may be in some embodiments predetermined by the user and set on the second device 210 through a user interface.

The various components of the first device 100 or second device 110 shown in FIG. 1, and the various components of the first device 200 and second device 210 shown in FIG. 2, may include memory which may be a combination of volatile and nonvolatile memory elements. For example the alarm clock 113 may include non-volatile memory which is operative to store settings set by the user and which may be adjusted by the sleep monitor 120 or 220 based on the hypnagogic chart developed by the sleep monitor for the specific user.

The various components shown and described in FIG. 1 and FIG. 2 may be implemented independently as software and/or firmware executing on one or more programmable processors, and may also include, or may be implemented independently, using ASICs, DSPs, hardwired circuitry (logic circuitry), or combinations thereof. That is, the sleep monitors may be implemented using an ASIC, DSP, executable code executing on a processor, logic circuitry, or combinations thereof.

The adjustable clock circuit 102 may be implemented in any of the above described ways and/or may be built from using oscillators, comparators, operational amplifiers, other active components such as transistors, and passive components such as, but not limited to, capacitors, resistors etc., all of which are understood to be present by those of ordinary skill for implementing an adjustable clock circuit. In some embodiments, the clock circuit or any of the other components may be integrated into, or provided by, the sleep monitors as shown in the respective figures.

In the embodiment illustrated in FIG. 3, the sleep monitor 300 is software or firmware that may operate in an application layer of a protocol stack executed by the processor 320. That is, the sleep monitor 300 may have corresponding executable code 300C stored in memory 311 that is read from memory by processor 320 and executed accordingly to perform the methods of operation and to provide the features and functions herein described. Additionally the alarm clock 307 may be an application having executable code that is executed and run by the processor 320. The alarm clock executable code 307C may also be stored in memory 311 and read and executed by processor 320 accordingly.

In accordance with some embodiments, the sleep monitor 300 interacts with alarm clock 307 by an application programming interface (API) 305. The API 305 enables exchange of information and command-and-control signals between the controller 303 of the sleep monitor 300 and the alarm clock 307. For example, the controller 303 may detect when the alarm clock 307 enters into the snooze mode by receiving information from the alarm clock 307 via the API 305. Likewise, the controller 303 may send a control signal to the alarm clock 307 through the API 305 to trigger the snooze alarm in certain circumstances as were described above with respect to FIG. 1 and FIG. 2. Additionally, based on the hypnagogic information developed by the sleep data collection and processing unit 301 of the sleep monitor 300, the controller 303 may send adjustment signals to the alarm clock 307 via the API 305. That is, the controller 303 may adjust various settings of the alarm clock 307 based on hypnagogic chart developed for a specific user.

The memory 311 may store the hypnagogic information 350 for use by the alarm clock 307 and the hypnagogic information 350 may be updated from time to time by the controller 303 of the sleep monitor 300. The sleep monitor 300 executes on processor 320 and accesses the memory 311 via a communication bus 309 which operatively connects the processor 320 to the memory 311. The wearable device 310 may also include a display 313 which, in some embodiments, may provide a graphical user interface. The wearable device 310 also includes other UI 315 which may be any suitable user interfaces such as buttons, a mouse control, touch sensor controls, gesture controls, gyroscopic controls or any other suitable user interface. The sensor 103 may be an accelerometer, a gyroscopic sensor, a capacitive touch sensor, or any other suitable sensor that may detect motion. That is, in some embodiments, the sleep data collection and processing unit 301 uses motion data and processes motion data by, among other things, comparing it to known motion patterns for given sleep states in order to determine the hypnagogic information 350 for the particular user. The known sleep motion patterns 340 may be stored in memory 311 and accessed by the sleep data collection and processing unit 301 over the communication bus 309. Raw data collected from the sensor 103 by the sleep data collection and processing unit 301 may also be stored in memory 311 in some embodiments. Alarm clock 307 settings that are adjusted by the user, or by the controller 303 as was discussed above, may be stored in memory 311 as settings 330 which may be subsequently accessed by the alarm clock 307 or by the sleep monitor 300 as necessary.

The various embodiments also include non-volatile, non-transitory computer readable memory, other than memory 311, that may contain executable instructions or executable code, such as 300C or 307C, for execution by at least one processor, that when executed, cause the at least one processor to operate in accordance with the functionality and methods of operation herein described. The computer readable memory may be any suitable non-volatile, non-transitory, memory such as, but not limited to, programmable chips such as EEPROMS, flash ROM (thumb drives), compact discs (CDs) digital video disks (DVDs), etc., that may be used to load executable instructions or program code to other processing devices such as wearable devices or other devices such as those that may benefit from the features of the herein described embodiments.

Returning briefly to the systems shown in FIG. 1 and FIG. 2, a user of the respective first device pairs that device with the second device using the wireless link 130. The first device is a wearable device such as a wristwatch, ring, anklet, etc., and the second device is a mobile device such as, but not limited to, a mobile phone or a portable alarm clock. The wearable device then collects data related to specific physiological parameters of the user within each of a set of time intervals, and processes this data in order to determine the one or more sleep states, and transitions between sleep states, of the user within each of the time intervals.

As was discussed briefly in the Background, the sleep states may be considered as falling into four broad categories: a) the deep sleep state, b) the shallow sleep state, c) the REM (Rapid Eye Movement) state, and d) an intermediate state where the user is partially awake yet partially sleep. Any of these states, or transitions from one state to another, may be used to trigger the snooze alarm as was described above. However, scientific research implies that the most optimum wake up experience is realized when a person transitions from the REM state to the awake state.

The alarm clock 113 provides a user-defined wake-up time and may also allow the user to set the sleep state or sleep state transitions that are used to trigger the wake-up alarm or the snooze alarms. The user may also enable a setting that allows the sleep monitor to make adjustments to the alarm clock 113 settings based on the hypnogogic information determined from monitoring one or more sleep cycle intervals.

As understood from FIG. 1, FIG. 2 and FIG. 3, data is processed in order to determine if at any point in time prior to the occurrence of the first snooze alarm event the user is in a given sleep state such as the REM sleep state. If the condition is determined to be valid, the first snooze alarm is immediately triggered. This method of operation may be repeated in case the subsequent snooze alarm modes that are not disabled by user intervention or by a timeout setting. The data processing described above may be performed by the wearable device, or by the wearable device operating in conjunction with the mobile device. Alternatively, as shown in FIG. 3, the entire method of operations may be performed by a wearable device. In the various embodiments related to FIG. 1 and FIG. 2, the alarm clock 113 functions may be distributed between either of the two devices. For example, in FIG. 1, the alarm clock 113 snooze alarm may be activated by pressing a button, or using some other user interface, of the first device 100.

Figure 4:
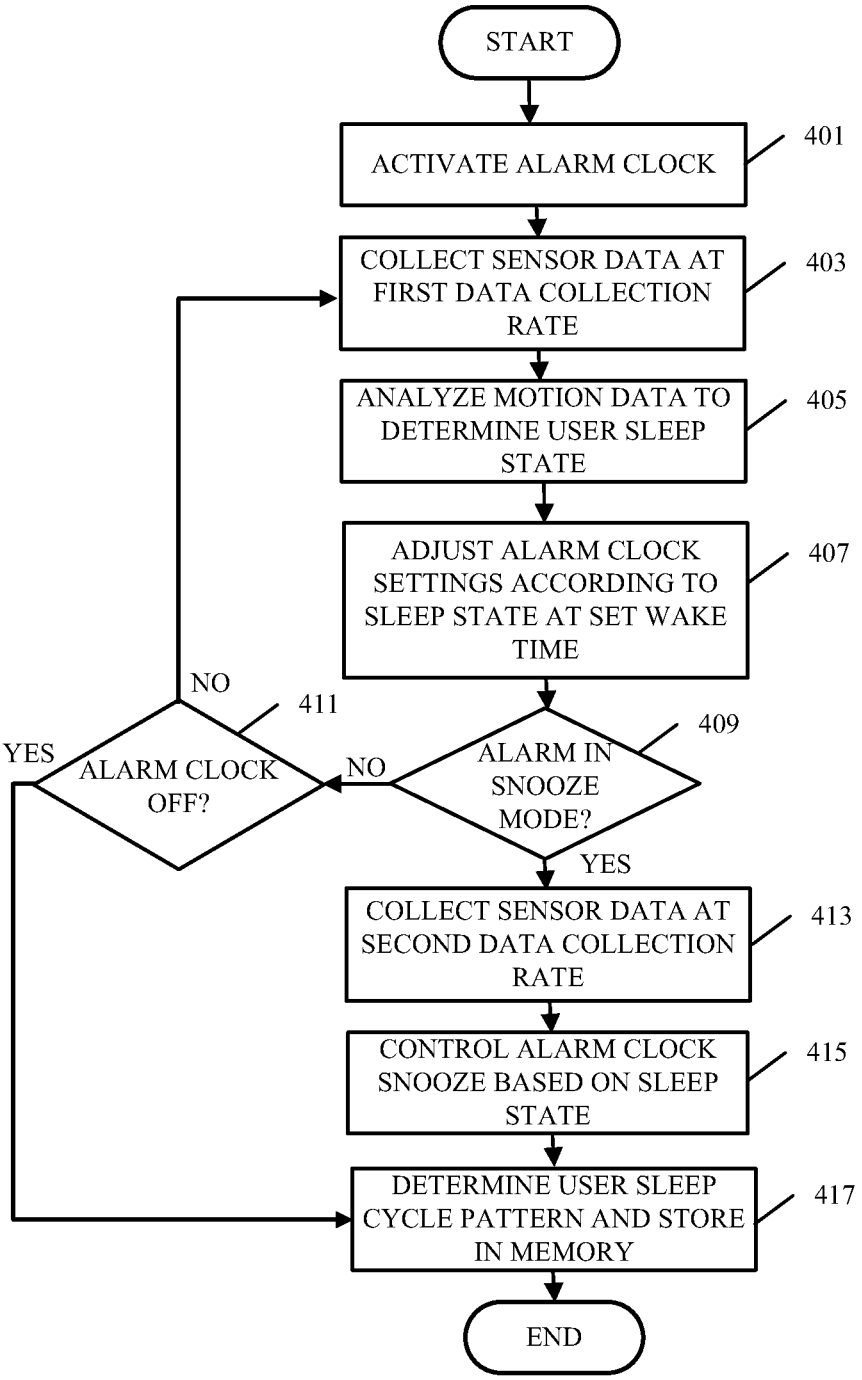
FIG. 4 is a flow chart showing a method of operation in accordance with various embodiments.

Turning now to FIG. 4, one such method of operation is illustrated and begins in block 401 where the alarm clock is activated. As shown in block 403, sensor data is collected at the first data collection rate. The sensor data may be motion data which may be analyzed to determine the user sleep state as shown in block 405. Settings of the alarm clock may be adjusted according to the sleep state occurring at the set wake time as shown in block 407. For example, if the sleep state determined by the sleep monitor close to the set wake up time for the alarm clock is a given sleep state, the sleep monitor may adjust various alarm clock settings such as the volume of the alarm, the type of alarm, the rate of frequency of alarm pulse, the luminosity of a flashing alarm light, or any other suitable setting that may be made to the particular device which has the alarm clock functionality.

The sleep monitor may detect whether the alarm clock has entered into a snooze mode as shown in decision block 409. If not, the sleep monitor may determine if the alarm clock is turned off in decision block 411. For example, the user may have responded to the initial wake-up alarm by turning it off and by not invoking the snooze mode at all. In that case the sleep monitor determines the user sleep cycle pattern that was observed during the sleep period prior to the alarm and stores this information in memory 311 as hypnagogic information 350. This operation is shown in block 417, at which point the method of operation ends. However, if the alarm clock has not been turned off in decision block 411, then the sleep monitor continues to collect sensor data at the first data collection rate as shown in operation block 403 and the operation loops until an alarm event occurs.

If the alarm clock enters into snooze mode in decision block 409, then the sleep monitor collects sensor data at a second data collection rate as shown in block 413. The second data collection rate is higher than first data collection rate. In block 415, the sleep monitor controls the alarm clock snooze based on the determined sleep state. For example, as was discussed above, for a given sleep state, the sleep monitor may automatically trigger the snooze alarm rather than waiting for the snooze alarm timer cycle to be completed. The sleep monitor determines the user sleep cycle pattern for the sleep period up until the alarm cycle and stores the sleep cycle pattern as hypnagogic information 350 in memory 311 as shown in block 417 and the method of operation ends.

Figure 5:
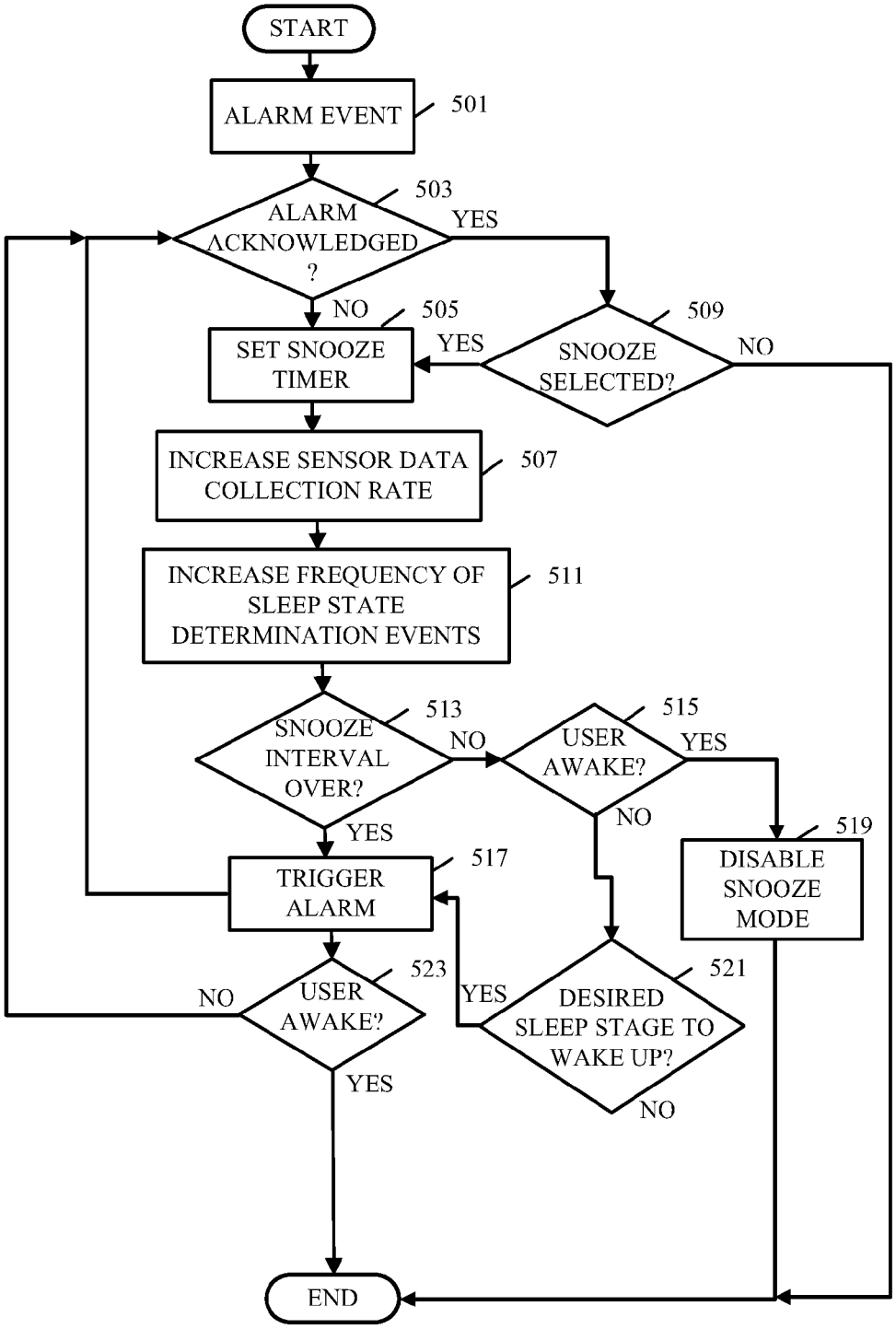
FIG. 5 is a flow chart showing a method of operation in accordance with various embodiments.

FIG. 5 illustrates additional details of a method of operation in accordance with an embodiment. The method of operation begins when an alarm event occurs as shown in block 501. The alarm may be acknowledged by the user is shown in decision block 503. The acknowledgement may be made by, for example, turning the alarm off, or hitting the snooze button on the device having the alarm clock feature. If the alarm is acknowledged in decision block 503, and snooze mode is not selected in decision block 509, then the method of operation ends. If the alarm is acknowledged by selecting the snooze feature in decision block 509, then the snooze timer is set as shown in operation block 505. This may also occur automatically if the alarm is not acknowledged in decision block 503. For example, in some embodiments, the alarm may go on acknowledged for a period of time after which the snooze timer is automatically set in block 505. At this point, the sleep monitor will detect that snooze mode has been entered into and will increase the sensor data collection rate to the second data collection rate higher than the first data collection rate as shown in operation block 507. The sleep monitor will also increase the frequency of sleep state determination events as shown in operation block 511.

If the snooze interval terminates as shown in decision block 513, then the snooze alarm is triggered in block 517. If the user is determined to be awake by the sleep monitor in decision block 523, then the method of operation ends as shown. If the user is not determined to be awake, then the sleep monitor looks for alarm acknowledgment in decision block 503. If the alarm is not acknowledged, then the snooze timer may be automatically set once again in block 505. The snooze operation may continue for a set number of intervals until the snooze operation eventually terminates due to a predetermined allowed number of snooze alarms, or until the sleep monitor determines that the user is awake in decision block 523.

As long as the snooze interval is not terminated in decision block 513, the sleep monitor will check to see if the user is awake as shown in decision block 515. If the user is determined to be awake in decision block 515, then the sleep monitor will send a control signal to the alarm clock to disabled snooze mode as shown in operation block 519 and the method of operation ends. If the user is not determined to be awake in decision block 515, then the sleep monitor will determine if the user is in the sleep stage for which it is desirable to trigger a wake up alarm as shown in decision block 521. For example, the REM sleep state may be a desirable given sleep state for which to trigger an immediate alarm. Therefore, in this example, if the user is determined to be in, or to have transitioned to, a REM sleep state in decision block 521, then the snooze alarm is immediately triggered as shown in block 517, and the method of operation continues as shown until the user is determined to be awake in either decision block 523 or decision block 515 etc.

As can be understood from the flowchart of FIG. 5 the snooze alarm may be terminated either by allowing it to operate only for a set number or predetermined number of snooze intervals, or may be terminated only when a determination is made that the user is actually awake.

In some embodiments, motion data may be used to make the determination of whether the user is awake. The motion data may be obtained by using an accelerometer, a gyroscopic position sensor, or capacitive touch sensor that is configured to operate as motion detection sensor.

The various embodiments described above provide various advantages over prior systems. One example advantage is that by increasing the rate of data collection and increasing the frequency of sleep state determination events, transitions from one sleep state to another sleep state may be more readily determined, so that the snooze alarm and other features of the alarm clock may be more accurately controlled according to the particular persons hypnagogic pattern, for example, as determined by the hypnagogic information 350 stored in memory 311.

Another advantage of the various embodiments, is that by increasing the rate of data collection during the snooze mode of operation in the various embodiments the hypnagogic pattern for a particular user can be more accurately determined and filtered for various noise conditions or conditions related to position of the sensor for various types of wearable devices that may house the sensor. Other advantages provided by the various embodiments herein disclosed will become apparent to those of ordinary skill.

While various embodiments have been illustrated and described, it is to be understood that the invention is not so limited. Numerous modifications, changes, variations, substitutions and equivalents will occur to those skilled in the art without departing from the scope of the present invention as defined by the appended claims.

What is claimed is:

1. A method comprising:

collecting, by a wearable device, motion sensor data at a first data collection rate, the motion sensor data indicating a motion of a person wearing the wearable device;

determining, by the wearable device and based on the motion sensor data, a sleep state of the person;

determining, by the wearable device, that an alarm clock system has entered a snooze mode; and responsive to determining that the alarm clock system has entered the snooze mode and while the alarm clock system is in the snooze mode, collecting additional motion sensor data at a second data collection rate greater than the first data collection rate.

2. The method of claim 1, further comprising:

while the alarm clock system is in the snooze mode, periodically determining the sleep state of the person.

3. The method of claim 1, further comprising:

responsive to determining that the person is awake, automatically disabling the snooze mode.

4. The method of claim 1, further comprising:

while the alarm clock system in in the snooze mode:

determining, based on the motion sensor data, whether the person has entered into a given sleep state; and responsive to determining that the person has entered into the given sleep state, triggering a snooze alarm.

5. The method of claim 4, wherein the given sleep state is a rapid eye movement (REM) sleep state.

6. The method of claim 1, wherein collecting additional motion sensor data at the second data collection rate greater than the first data collection rate comprises:

increasing a clock frequency of a clock circuit of a motion data collector of the wearable device.

7. The method of claim 1, further comprising:

sending, by the wearable device and to another device, the motion sensor data; and receiving, by the wearable device and from the other device, a control signal, wherein collecting the additional motion sensor data at the second data collection rate greater than the first data collection rate is in response to receiving the control signal.

8. A wearable device, comprising:

a motion sensor;

an alarm clock system; and a sleep monitor operatively coupled to the motion detection sensor and the alarm clock, the sleep monitor operative to:

collect motion sensor data from the motion sensor at a first data collection rate, the motion sensor data indicating a motion of a person wearing the wearable device;

determine, based on the motion sensor data, a sleep state of the person;

determine that the alarm clock system has entered a snooze mode; and responsive to determining that the alarm clock system has entered the snooze mode and while the alarm clock system is in the snooze mode, collect additional motion sensor data at a second data collection rate greater than the first data collection rate.

9. The wearable device of claim 8, wherein the sleep monitor is further operative to:

while the alarm clock system is in the snooze mode, periodically determine the sleep state of the person.

10. The wearable device of claim 8, wherein the sleep monitor is further operative to:

responsive to determining that the person is awake, automatically disable the snooze mode.

11. The wearable device of claim 8, wherein the sleep monitor is further operative to:

while alarm clock system is in the snooze mode:

determine, based on the motion sensor data, whether the person has entered into a given sleep state; and responsive to determining that the person has entered into the given sleep state, trigger a snooze alarm.

12. The wearable device of claim 11, wherein the given sleep state is a rapid eye movement (REM) sleep state.

13. The wearable device of claim 8, wherein the sleep monitor comprises a motion data collector, the wearable device further comprising:

a clock circuit operatively coupled to the motion data collector, wherein the motion data collector is operative to collect the additional motion sensor data at the second data collection rate greater than the first data collection rate by at least increasing a clock frequency of the clock circuit.

14. The wearable device of claim 8, further comprising:

a wireless transceiver, wherein the sleep monitor is further operative to:

send, via the wireless transceiver and to another device, the motion sensor data;

receive, via the wireless transceiver and from the other device, a control signal; and collect the additional motion sensor data at the second data collection rate greater than the first data collection rate in response to receiving the control signal.

15. A wearable device, comprising:

a motion sensor;

a wireless transceiver; and a motion data collector, operatively coupled to the motion detection sensor, the motion data collector operative to:

collect motion sensor data at a first data collection rate, the motion sensor data indicating a motion of a person wearing the wearable device;

send, via the wireless transceiver, the motion sensor data to a mobile device;

receive, via the wireless transceiver, a control signal from the mobile device;

responsive to receiving the control signal, collect additional motion sensor data at a second data collection rate greater than the first data collection rate; and send, via the wireless transceiver, the motion detection sensor data to the mobile device.

16. The wearable device of claim 15, further comprising:

a clock circuit operatively coupled to the motion data collector, wherein the motion data collector is further operative to collect the additional motion sensor data at the second data collection rate greater than the first data collection rate by at least increasing a clock frequency of the clock circuit.

* * * * *